US010643575B2

(12) United States Patent
Xu

(10) Patent No.: US 10,643,575 B2
(45) Date of Patent: May 5, 2020

(54) CLOCK SIGNAL AUXILIARY CIRCUIT, AND DISPLAY DEVICE

(71) Applicants: Fuzhou BOE Optoelectronics Technology Co., Ltd., Fuzhou (CN); BOE TECHNOLOGY GROUP CO., LTD., Beijing (CN)

(72) Inventor: Weize Xu, Beijing (CN)

(73) Assignees: Fuzhou BOE Optoelectronics Technology Co., Ltd., Fuzhou (CN); BOE TECHNOLOGY GROUP CO., LTD., Beijing (CN)

( * ) Notice: Subject to any disclaimer, the term of this patent is extended or adjusted under 35 U.S.C. 154(b) by 0 days.

(21) Appl. No.: 16/404,210

(22) Filed: May 6, 2019

(65) Prior Publication Data

US 2020/0020299 A1 Jan. 16, 2020

(30) Foreign Application Priority Data

Jul. 13, 2018 (CN) ..... 2018 1 0771267

(51) Int. Cl.
*G09G 5/00* (2006.01)

(52) U.S. Cl.
CPC ..... *G09G 5/008* (2013.01); *G09G 2310/0286* (2013.01); *G09G 2310/0291* (2013.01); *G09G 2320/041* (2013.01); *G09G 2330/021* (2013.01)

(58) Field of Classification Search
CPC ..... G09G 5/003; G09G 2330/021; G09G 2330/022; G09G 2310/0291; G09G 2320/041; G09G 2320/045; G09G 2320/06; G09G 2330/02; G09G 2330/00; G09G 2330/027
See application file for complete search history.

(56) References Cited

U.S. PATENT DOCUMENTS

2016/0344220 A1* 11/2016 Liu ..... G09G 3/3648
2018/0012533 A1* 1/2018 Lee ..... G09G 3/2092
2018/0053463 A1* 2/2018 Kong ..... G09G 3/20
2019/0057668 A1* 2/2019 Xiong ..... G09G 3/3696

FOREIGN PATENT DOCUMENTS

TW 378266 12/2012
TW I378266 12/2012

* cited by examiner

*Primary Examiner* — Dennis P Joseph
(74) *Attorney, Agent, or Firm* — Thomas | Horstemeyer LLP

(57) ABSTRACT

The present disclosure relates to display technologies, and particularly to a clock signal auxiliary circuit and a display device. The circuit can include a voltage detection circuit, a thermal sensitive sensing circuit, a control circuit, a switch selection circuit, and a signal amplification circuit. The clock signal auxiliary circuit can generate different detection signals according to different ambient temperatures during operation, and generate different control signals according to different detection signals, so as to turn on different channels according to different control signals, pull the clock signal that is finally output to the output end up to the correct potential, and generate correct scan signals at different ambient temperatures according to the clock signal pulled up to the correct potential.

20 Claims, 4 Drawing Sheets

CLOCK SIGNAL AUXILIARY CIRCUIT, AND DISPLAY DEVICE

CROSS-REFERENCE TO RELATED APPLICATION

This application claims the benefit of and priority to Chinese Patent Application 201810771267.9, filed on Jul. 13, 2018, the contents of which being incorporated by reference in their entirety herein.

TECHNICAL FIELD

The present disclosure relates to display technologies, and particularly to a clock signal auxiliary circuit and a display device.

BACKGROUND

Presently, most display devices support a discharge function. That is, when the power is turned off, an operating voltage of a display device will gradually decrease, and when the operating voltage is lower than a preset voltage, a clock signal input to a shift register will be pulled up to a first potential so that the shift register generates scan signals according to the clock signal which has been pulled up to the first potential to turn on a switching element in a pixel, which completely releases charges in the pixel, and thus avoids a long-term existence of the charge, which may result in residual image, flickering, and so on.

SUMMARY

Embodiments of the present disclosure include a clock signal auxiliary circuit and a display device According to an aspect of the present disclosure, a clock signal auxiliary circuit is provided, where the clock signal auxiliary circuit is configured to provide a clock signal to a shift register. The clock signal auxiliary circuit includes:

a voltage detection circuit connected to a first node, and configured to detect an operating voltage, pull the clock signal up to a first potential when the operating voltage is lower than a preset voltage, and provide the clock signal after being pulled up to the first node;

a thermal sensitive sensing circuit configured to detect the operating voltage and an ambient temperature in real time, and output a detection signal according to the operating voltage and the ambient temperature;

a control circuit connected to the thermal sensitive sensing circuit and a second node, and configured to provide a control signal to the second node according to the detection signal;

a switch selection circuit connected to the first node, the second node, a third node, and an output end, and configured to connect the first node and the output end or connect the first node and the third node in response to the control signal of the second node; and a signal amplification circuit connected to the third node and the output end, and configured to amplify a signal of the third node and output the amplified signal to the output end.

According to an example embodiment of the present disclosure, the thermal sensitive sensing circuit is configured to:

output a first detection signal when the operating voltage is lower than the preset voltage and the ambient temperature is lower than a preset temperature; and output a second detection signal when the operating voltage is lower than the preset voltage and the ambient temperature is higher than the preset temperature.

According to an example embodiment of the present disclosure, the control circuit is configured to:

provide a first control signal to the second node according to the first detection signal; and provide a second control signal to the second node according to the second detection signal.

According to an example embodiment of the present disclosure, the switch selection circuit is specifically configured to:

connect the first node and the third node in response to the first control signal; and connect the first node and the output end in response to the second control signal.

According to an example embodiment of the present disclosure, a first end of the voltage detection circuit receives the clock signal, a second end of the voltage detection circuit receives the operating voltage, and a third end of the voltage detection circuit is connected to the first node;

the thermal sensitive sensing circuit comprises:

a first resistor, a first end of the first resistor receiving a second power signal;

a thermistor, wherein a first end of the thermistor is connected to a second end of the first resistor, and a second end of the thermistor receives a first power signal; and a NOR gate, wherein a first end of the NOR gate is connected to the second end of the first resistor, and a second end of NOR gate receives the operating voltage;

the control circuit comprises:

a current source, wherein a first end of the current source is connected to a third end of the NOR gate, and a second end of the current source is connected to the second node, and the current source is configured to generate a current according to the detection signal, and provide the control signal to the second node according to the current; and a second resistor, wherein a first end of the second resistor is connected to the second node, and a second end of the second resistor receives the second power signal;

the switch selection circuit comprises:

a first switching element, wherein a control end of the first switching element is connected to the second node, a first end of the first switching element is connected to the first node, and a third end of the first switching element is connected to the output end; and a second switching element, wherein a control end of the second switching element is connected to the second node, a first end of the second switching element is connected to the first node, and a second end of the second switching element is connected to the third node; wherein wherein the first switching element and the second switching element have opposite conduction levels;

the signal amplification circuit comprises:

a third resistor, wherein a first end of the third resistor is connected to the third node;

an operational amplifier, wherein a first end of the operational amplifier is connected to a second end of the third resistor, a second end of the operational amplifier is connected to a fourth node, a third end of the operational amplifier is connected to the output end, a fourth end of the operational amplifier receives the first power signal, and a fifth end of the operational amplifier receives the second power signal;

a fourth resistor, wherein a first end of the fourth resistor is connected to the output end, and a second end of the fourth resistor is connected to the fourth node; and a fifth resistor, wherein a first end of the fifth resistor is connected to the fourth node, and a second end of the fifth resistor receives the second power signal According to an example embodiment of the present disclosure, the thermal sensitive sensing circuit further comprises:

a first storage capacitor, wherein a first end of the first storage capacitor receives the first power signal, and a second end of the first storage capacitor receives the second power signal According to an example embodiment of the present disclosure, the control circuit further comprises:

a sixth resistor, wherein a first end of the sixth resistor is connected to the second end of the current source, and a second end of the sixth resistor is connected to the second node.

According to an example embodiment of the present disclosure, the signal amplification circuit further comprises:

a second storage capacitor, wherein a first end of the second storage capacitor receives the first power signal, and a second end of the second storage capacitor receives the second power signal.

According to an example embodiment of the present disclosure, the first switching element is a P-type transistor, and the second switching element is an N-type transistor; or the first switching element is an N-type transistor, and the second switching element is a P-type transistor.

According to an aspect of the present disclosure, a display device is provided including the clock signal auxiliary circuit according to any of the above embodiments.

BRIEF DESCRIPTION OF THE DRAWINGS

The above and other features and advantages of the present disclosure will become more apparent from the exemplary embodiments described in detail with reference to the drawings. It is understood that the drawings in the following description show only some of the embodiments of the present disclosure, and other drawings may be obtained by those skilled in the art without departing from the drawings described herein. In the drawings.

DETAILED DESCRIPTION

Figure 1:
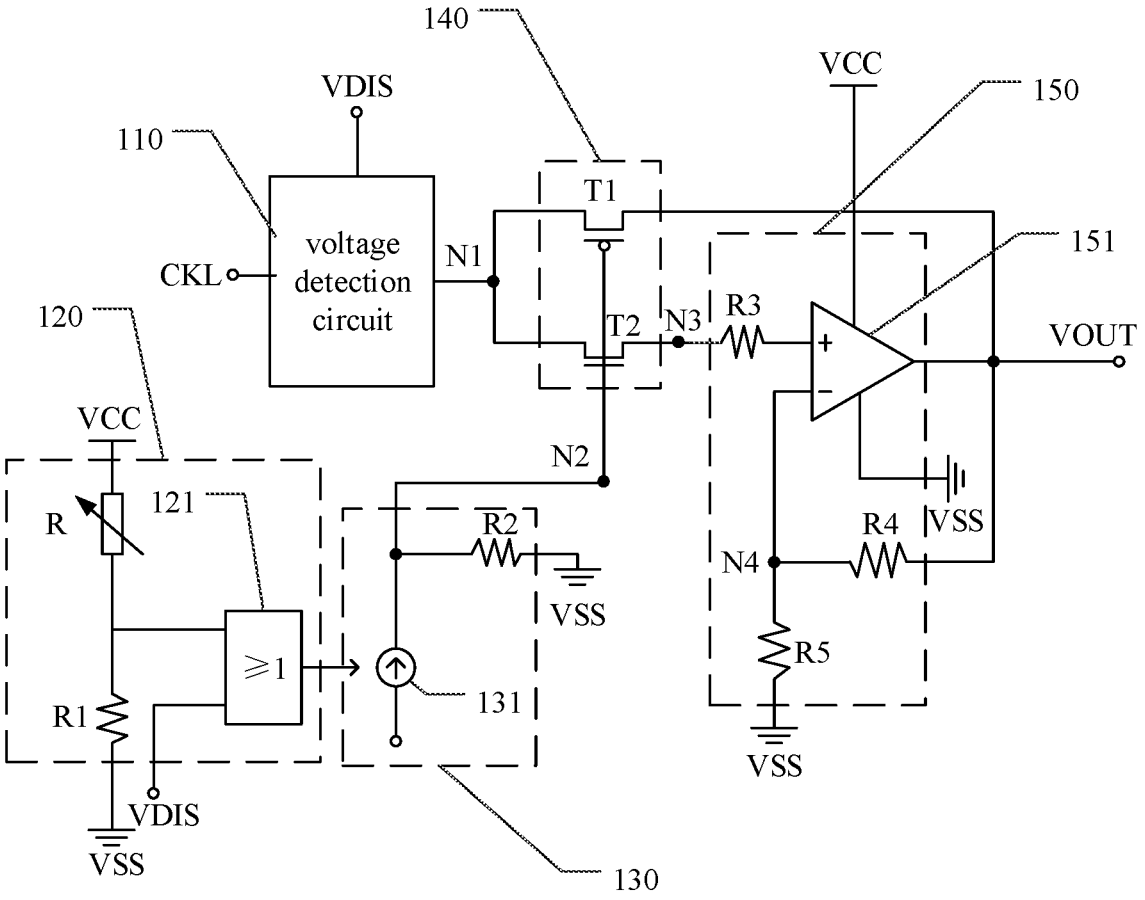
FIG. 1 is a schematic diagram of a clock signal auxiliary circuit according to an embodiment of the present disclosure.

Example embodiments will now be described more completely with reference to the accompanying drawings. However, the embodiments can be implemented in a variety of forms and should not be construed as being limited to the examples set forth herein; rather, these embodiments are provided so that this disclosure will be more complete so as to convey the idea of the exemplary embodiments to those skilled in this art. The described features, structures, or characteristics in one or more embodiments may be combined in any suitable manner. In the following description, numerous specific details are set forth to provide a full understanding of the embodiments of the present disclosure. However, one skilled in the art will appreciate that the technical solutions of the present disclosure can be practiced when one or more of the described specific details may be omitted or other methods, components, devices, steps, etc. may be employed. In other instances, well-known technical solutions are not shown or described in detail to avoid obscuring aspects of the present disclosure.

In addition, the drawings are merely schematic representations of the present disclosure and are not necessarily drawn to scale. The same reference numerals in the drawings denote the same or similar parts, and the repeated description thereof will be omitted.

In the method of the related arts, since the clock signal pulled up to the first potential gradually decreases during the shutdown process, the scan signals generated according to the clock signal pulled up to the first potential may not completely turn on the switching elements in the pixels in a low temperature environment, causing different degrees of charge to remain in each pixel in the display device, which results in bright and dark LPS (Limit Power Sequence) horizontal stripes. In other words, in the related arts, it is not possible to pull the clock signal up to the correct potential according to the ambient temperature, so that the correct scan signals cannot be generated to completely turn on the switching elements in the pixels at different ambient temperatures.

Therefore, it is desirable to provide a circuit that can pull the clock signal up to the correct potential according to the ambient temperature.

An embodiment provides a clock signal auxiliary circuit. Referring to FIG. 1, the clock signal auxiliary circuit may include: a voltage detection circuit 110, a thermal sensitive sensing circuit 120, a control circuit 130, a switch selection circuit 140, and a signal amplification circuit 150.

The voltage detection circuit 110 is connected to a first node N1, and is configured to detect the operating voltage VDIS, pull up the clock signal CKL to a first potential (or first level) VGH when the operating voltage VDIS is lower than a preset voltage, and provide the clock signal CKL after being pulled up to the first node N1.

The thermal sensitive sensing circuit 120 is configured to detect the operating voltage VDIS and the ambient temperature in real time, and output a detection signal according to the operating voltage VDIS and the ambient temperature.

The control circuit 130 is connected to the thermal sensitive sensing circuit 120 and the second node N2, and is configured to provide a control signal to the second node N2 according to the detection signal.

The switch selection circuit 140 is connected to the first node N1, the second node N2, the third node N3, and the output end VOUT, and is configured to connect the first node N1 and output end VOUT or connect the first node N1 and the third node N3 in response to the control signal at the second node N2.

The signal amplification circuit 150 is connected to the third node N3 and the output end VOUT, and is configured to amplify the signal at the third node N3 and then output the amplified signal to the output end VOUT.

The present disclosure provides a clock signal auxiliary circuit. The clock signal auxiliary circuit may include: a voltage detection circuit, a thermal sensitive sensing circuit, a control circuit, a switch selection circuit, and a signal amplification circuit. During the operation of the clock signal auxiliary circuit, the thermal sensitive sensing circuit outputs the detecting signal according to the operating voltage and the ambient temperature, and the control circuit provides the control signal to the second node according to the detecting signal, so that the switch selection circuit connects the first node and the third node (that is, a first channel is available) or connect the first node and the output end (that is, a second channel is available). Specifically, when the first node and the third node are connected, the clock signal after being pulled up is amplified by the signal amplification circuit and then output to the output end; when the first node and the output end are connected, the clock signal after being pulled up is directly output to the output end. In other words, during the shutdown process (i.e., during the process that the operating voltage is lower than the preset voltage), different detection signals are generated according to different ambient temperatures, and different control signals are generated according to different detection signals to turn on different channels according to different control signals, so as to make the clock signal finally output to the output end to be pulled up to the correct potential according to different ambient temperatures. Additionally, correct scan signals can be generated according to the clock signal pulled up to the correct potential to completely turn on the switching element in the pixel at different ambient temperatures, completely releasing the charge in the pixel to avoid occurrence of LPS horizontal stripes.

Specifically, the thermal sensitive sensing circuit 120 may be configured to: output a first detection signal when the operating voltage VDIS is lower than the preset voltage and the ambient temperature is lower than a preset temperature; and output the second detection signal when the operating voltage VDIS is lower than the preset voltage and the ambient temperature is higher than the preset temperature.

On the basis of the foregoing, the control circuit 130 may be specifically configured to: provide a first control signal to the second node N2 according to the first detection signal; and provide a second control signal to the second node N2 according to the second detection signal.

On the basis of the above, the switch selection circuit 140 may be specifically configured to: connect the first node N1 and the third node N3 in response to the first control signal; and connect the first node N1 and output end VOUT in response to the second control signal.

In the present example embodiment, the operating voltage VDIS refers to an operating voltage when the display device is in operation. During the shutdown process of the display device, the operating voltage VDIS gradually decreases. When the display device is normally displaying images, the operating voltage VDIS does not change. Therefore, whether or not the display device is in the shutdown process can be determined according to the change in the operating voltage VDIS. The preset voltage may be determined according to a specific circuit structure, and is not particularly limited herein.

Next, the operation process of the above-described clock signal auxiliary circuit will be described in detail.

The voltage detection circuit 110 detects the magnitude of the operating voltage VDIS in real time. When the operating voltage VDIS is lower than the preset voltage (i.e., when the display device is in the process of shutdown), the clock signal CKL is pulled up to the first potential VGH, and the clock signal CKL after being pulled up is provided to the first node N1, that is, the clock signal CKL of the first potential VGH is provided to the first node N1.

At the same time, the thermal sensitive sensing circuit 120 detects the operating voltage VDIS and the ambient temperature in real time, and outputs a first detection signal when the operating voltage VDIS is lower than the preset voltage and the ambient temperature is lower than the preset temperature. The control circuit 130 provides a first control signal to the second node N2 according to the first detection signal, so that the switch selection circuit 140 connects the first node N1 and the third node N3 in response to the first control signal. At this time, the clock signal CKL, which has been pulled up and transmitted to the first node N1, is transmitted to the third node N3, and the signal amplification circuit 150 amplifies the clock signal CKL after being pulled up and transmitted to the third node N3, and then outputs the amplified signal to the output end VOUT.

The thermal sensitive sensing circuit 120 outputs a second detection signal when the operating voltage VDIS is lower than the preset voltage and the ambient temperature is higher than the preset temperature. The control circuit 130 provides a second control signal to the second node N2 according to the second detection signal, so that the switch selection circuit 140 connects the first node N1 and the output end VOUT in response to the second control signal. At this time, the clock signal CKL, which has been pulled up and transmitted to the first node N1, is transmitted to the output end VOUT. It should be noted that the above preset temperature can be obtained according to experiments.

As can be seen from the above, in the shutdown process, when the ambient temperature is lower than the preset temperature, the first node N1 and the third node N3 are connected to amplify the clock signal CKL after being pulled up by the signal amplification circuit 150, and then the signal is output to the output end VOUT. When the ambient temperature is not lower than the preset temperature, the first node N1 and the output end VOUT are connected to directly output the clock signal CKL after being pulled up to the output end VOUT. That is, depending on different ambient temperatures, different signal transmission paths are enabled to pull up the clock signal CKL that is finally output to the output end VOUT to the correct potential, so that correct scan signals can be generated according to the clock signal CKL which is pulled up to the correct potential. As a result, pixels at different ambient temperatures can be completely turned on to completely release the charge in the pixels to avoid occurrence of LPS horizontal stripes.

It should be noted that, when the operating voltage VDIS is not lower than the preset voltage, that is, when the display device is in the normal display state, regardless of whether the ambient temperature is higher than the preset temperature or lower than the preset temperature, the thermal sensitive sensing circuit 120 outputs the second detection signal. The control circuit 130 provides a second control signal to the second node N2 according to the second detection signal, so that the switch selection circuit 140 connects the first node N1 and the output end VOUT in response to the second control signal. At this time, due to the display state, the clock signal CKL is a signal that jumps between the first potential VGH and the second potential VGL, and therefore, the signal transmitted to the output end VOUT is a clock signal CKL that jumps between the first potential VGH and the second potential VGL.

Hereinafter, the configuration and connection relationship of individual circuits in the clock signal auxiliary circuit will be described in detail with reference to FIG. 1.

A first end of the voltage detection circuit 110 receives the clock signal CKL, a second end of the voltage detection circuit 110 receives the operating voltage VDIS, and a third end of the voltage detection circuit 110 is connected to the first node N1.

The thermal sensitive sensing circuit 120 may include: a first resistor R1, a thermistor R, and a NOR gate 121.

A first end of the first resistor R1 receives the second power signal VSS. A first end of the thermistor R is connected to a second end of the first resistor R1, and a second end of the thermistor R receives the first power signal VCC. A first end of the NOR gate 121 is connected to the second end of the first resistor R1, and a second end of the NOR gate 121 receives the operating voltage VDIS.

The control circuit 130 may include: a current source 131 and a second resistor R2.

A first end of the current source 131 is connected to a third end of the NOR gate 121, and a second end of the current source 121 is connected to the second node N2. The current source 131 is configured to generate a current according to the detection signal, and provide a control signal to the second node N2 according to the current. A first end of the second resistor R2 is connected to the second node N2, and a second end of the second resistor R2 receives the second power signal VSS.

The switch selection circuit 140 may include: a first switching element T1 and a second switching element T2.

A control end of the first switching element T1 is connected to the second node N2, a first end of the first switching element T1 is connected to the first node N1, and a third end of the first switching element T1 is connected to the output end VOUT. A control end of the second switching element T2 is connected to the second node N2, a first end of the second switching element T2 is connected to the first node N1, and a second end of the second switching element T2 is connected to the third node N3. The first switching element T1 and the second switching element T2 have opposite conduction levels.

The signal amplification circuit 150 may include: a third resistor R3, an operational amplifier 151, a fourth resistor R4, and a fifth resistor R5.

A first end of the third resistor R3 is connected to the third node N3. A first end of the operational amplifier 151 is connected to the second end of the third resistor R3, a second end of the operational amplifier 151 is connected to the fourth node N4, a third end of the operational amplifier the 151 is connected to the output end VOUT, a fourth end of the operational amplifier 151 receives the first power signal VCC, and the fifth end of the operational amplifier 151 receives the second power signal VSS. A first end of the fourth resistor R4 is connected to the output end VOUT, and a second end of the fourth resistor R4 is connected to the fourth node N4. A first end of the fifth resistor R5 is connected to the fourth node N4, and a second end of the fifth resistor R5 receives the second power signal VSS.

In the present example embodiment, the resistance value of the thermistor R is inversely proportional to the ambient temperature. That is, when the ambient temperature decreases, the resistance value of the thermistor R increases; and when the ambient temperature increases, the resistance value of the thermistor R decreases. The resistance values of the first to fifth resistors R1 to R5 can be calculated according to the specific requirements of the circuit.

The NOR gate 121 includes a first end, a second end, and a third end. The first end and the second end are an input end, and the third end is an output end. The logical relationship of the NOR gate is shown in Table 1 below:

TABLE 1

| first end | second end | third end |
|---|---|---|
| H | H | L |
| H | L | L |
| L | H | L |
| L | L | H |

It can be seen from the above Table 1 that when the two input ends (i.e., the first end and the second end) of the NOR gate 121 are both at a low level L, the output end (i.e., the third end) is at a high level; when one of the two inputs (i.e., the first end and the second end) of the gate 121 is at a high level, the output end (i.e., the third end) is at a low level. It should be noted that, during the operation of the NOR gate 121, when the signal input to the first end is not lower than the identification voltage of the first end, the NOR gate 121 identifies the signal of the first end as a high level; when the signal of the first end is lower than the identification voltage of the first end, the NOR gate 121 identifies the signal of the first end as a low level. Similarly, when the signal of the second end is not lower than the identification voltage of the second end, the NOR gate 121 identifies the signal of the second end as a high level, and when the signal of the second end is lower than the identification voltage of the second end, the gate 121 identifies the signal of the second end as a low level. It should be noted that the magnitude of the identification voltage of the first end may be calculated according to the preset temperature in combination with the parameters of other devices (such as other resistors) in the circuit, such that when the ambient temperature is lower than the preset temperature, the voltage of the signal at the first end of the NOR gate 121 is lower than the identification voltage of the first end. The identification voltage of the second end may be determined according to the preset voltage. It can be known from the nature of the NOR gate 121 that the detection signal generated by the thermal sensitive sensing circuit 120 is a high level signal or a low level signal.

The first switching element T1 and the second switching element T2 correspond to a first switching transistor and a second switching transistor, respectively. Each switching transistor has a control end, a first end, and a second end. For example, the control end may be a gate, the first end may be a source, and the second end may be a drain. In another example, the control end may be a gate, the first end may be a drain, and the second end may be a source. Embodiments of the present disclosure do not impose these specific limitations. The conduction levels of the first switching element T1 and the second switching element T2 are opposite, that is, when the conduction level of the first switching element T1 is a high level, the conduction level of the second switching element T2 is a low level. Alternatively, when the conduction level of the first switching element T1 is a low level, the conduction level of the second switching element T2 is a high level. According to the relationship between the conduction levels of the first switching element T1 and the second switching element T2, when the first switching element T1 is an N-type transistor, the second switching element T2 is a P-type transistor, or when the first switching element T1 is a P-type transistor, the second switching element T2 is an N-type transistor.

The current source 131 is configured to generate a current according to the detection signal, and provide a control signal to the second node N2 according to the current. It should be noted that the control signal of the second node N2 can be obtained according to the current generated by the second resistor R2 and the current source 131. Since the control signal of the second node N2 is used to turn on or off the first switching element T1 or the second switching element T2, the current source 131 can generate a current according to the detection signal, and determine the level of the control signal of the second node N2 by the current to determine to turn on the first switching element T1 or the second switching element T2 according to the level of the control signal. For example, when the conduction level of the first switching element T1 is at a low level, and the conduction level of the second switching element T2 is at a high level, signals of both input ends of the NOR gate 121 are recognized as low level signals, the output end of the NOR gate 121 is at a high level, that is, the detection signal is at a high level. According to the high level signal, the current source 131 generates a first current so as to provide a high level control signal to the second node to turn on the second switching element T2 and turn off the first switching element T1, and to connect the first node N1 and the third node N3. For another example, when the conduction level of the first switching element T1 is at a low level and the conduction level of the second switching element T2 is at a high level, one of the signals of the two input ends of the NOR gate 121 is recognized as a high level, the output end of the NOR gate 121 is at a low level, that is, the detection signal is at a low level. The current source 131 generates a first current according to the low level signal to provide a low level control signal to the second node N2, so as to turn off the second switching element T2 and turn on the first switching element T1 and thereby to connect the first node N1 and the output end VOUT.

The operational amplifier 151 can include a first end to a fifth end. The first end can be a non-inverting input end, the second end can be an inverting input end, the third end can be an output end, the fourth end is a first power signal end, and the fifth end may be a second power signal end. In another example, the first end may be an inverting input end, the second end may be a non-inverting input end, the third end may be an output end, the fourth end may be a first power signal end, and the fifth end may be a second power signal end.

Hereinafter, the working process of the above circuit is described by taking an example that the first switching element T1 is a P-type transistor, the second switching element T2 is an N-type transistor, the first power signal VCC is at a high level, the second power signal VSS is at a low level, the first end of the operational amplifier 151 is a non-inverting input end, the second end of the operational amplifier 151 is an inverting input end, and the third end of the operational amplifier 151 is an output end.

The voltage detection circuit 110 detects the magnitude of the operating voltage VDIS in real time. When the operating voltage VDIS is lower than the preset voltage, that is, during the shutdown process, the clock signal CKL is pulled up to the first potential VGH, and the clock signal CKL being pulled up to the first potential VGH is transmitted to the first node N1.

At the same time, the thermistor R senses the ambient temperature in real time and changes its resistance value as the ambient temperature changes. According to the circuit connection relationship, the voltage of the signal at the first end of the NOR gate 121 is V1=R1*VCC/(R+R1), and the signal at the second end of the NOR gate 121 is the operating voltage VDIS.

When the voltage V1 of the signal at the first end of the NOR gate 121 is lower than the identification voltage of the first end, the signal V1 at the first end of the NOR gate 121 is at a low level, and when the operating voltage VDIS is lower than the identification voltage of the second end, the signal at the second end of the NOR gate 121 is at a low level. Since the signals at the first end and the second end of the NOR gate 121 are both at a low level, the output signal of the NOR gate 121 is at a high level, that is, the detection signal is a high level signal. When the current source 131 receives the high level detection signal, the current is output according to the high level detection signal, so that the control signal of the second node N2 is a high level signal, thereby causing the first switching element T1 to be turned off and the second switching element T2 turned on to connect the first node N1 and the third node N3. At this time, the clock signal CKL pulled up to the first potential VGH at the first node N1 is transmitted to the third node N3, and amplified by the operational amplifier 151 and then output to the output end VOUT. Specifically, it can be seen from the connection relationship of the operational amplifier 151 that the amplification factor of the operational amplifier 151 is 1+R4/R5. According to the amplification factor, the magnitude of the clock signal CKL outputted to the output end VOUT is (1+R4/R5)VGH. It should be noted that the magnitude of the control signal of the second node N2 can be calculated according to the current generated by the current source 131 and the resistance of the second resistor R2. When the control signal of the second node N2 is greater than a voltage, the control signal of the second node N2 is at a high level, and when the control signal of the second node N2 is less than a voltage, the control signal of the second node N2 is at a low level. For example, when the control signal of the second node N2 is greater than 4V, the control signal of the second node N2 is at a high level, and when the control signal of the second node N2 is less than 1V, the control signal of the second node N2 is at a low level. It can be seen from the above that during the shutdown process, when the ambient temperature is lower than the preset temperature, the first node N1 and the third node N3 are connected to amplify the clock signal CKL pulled up to the first potential VGH and then the amplified signal is input to the output end VOUT.

When the voltage V1 of the signal of the first end of the NOR gate 121 is not lower than the identification voltage of the first end, that is, the first end of the NOR gate 121 is at a high level, and the signal of the second end of the NOT gate 121 (that is, the operating voltage VDIS) is lower than the identification voltage of the second end, that is, when the second end of the NOR gate 121 is at a low level, according to the nature of the NOR gate 121, the NOR gate 121 outputs a low level, that is, the detection signal is a low level signal. When the current source 131 receives the low level detection signal, the current is output according to the low level detection signal, so that the control signal of the second node N2 is a low level signal, thereby turning on the first switching element T1 and turning off the second switching element T2 to connect the first node N1 and the output end VOUT. At this time, the clock signal CKL pulled up to the first potential VGH at the first node N1 is transmitted to the output VOUT. It can be seen from the above that during the shutdown process, when the ambient temperature is not lower than the preset temperature, the first node N1 and the output end VOUT are connected to output the clock signal CKL pulled up to the first potential VGH directly to the output end V OUT.

When the signal of the second end of the NOR gate 121 (that is, the operating voltage VDIS) is not lower than the identification voltage of the second end, that is, the second end of the NOR gate 121 is at a high level, whether the voltage V1 of the signal of the first end of the NOR gate 121 is lower than the identification voltage of the first end or not, that is, whether the voltage V1 of the signal of the first end of the NOR gate 121 is at high level or low level, the output end of the gate 121 is a low level, that is, the detection signal is a low level signal. When the current source 131 receives the low level detection signal, the current source 131 generates a current according to the low level detection signal, so that the control signal of the second node is a low level signal, thereby turning on the first switching element T1 and turning off the second switching element T2 to connect the first node N1 and the output end VOUT. At this time, the signal of the second end of the NOR gate 121 (that is, the operating voltage VDIS) is not lower than the identification voltage of the second end, that is, the display device is not in the shutdown process, and therefore, the clock signal CKL transmitted to the first node N1 through the voltage detection circuit 110 jumps between the first potential VGH and the second potential VGL, and is directly transmitted to the output end VOUT. As can be seen from the foregoing, when the display device normally displays images, regardless of the ambient temperature, the first node N1 and the output end VOUT are connected to output a clock signal CKL that jumps between the first potential VGH and the second potential VGL to the output end VOUT.

It should be noted that the identification voltage of the first end may be set according to a preset temperature and a parameter of a device in the circuit, and the identification voltage of the second end is a preset voltage.

In summary, when the display device is in the display state, the clock signal CKL that jumps between the first potential VGH and the second potential VGL is transmitted to the output end VOUT by turning on the first switching element T1, so that the shift register generates scan signals according to the clock signal CKL to control pixels to display images by the scan signals.

When the display device is in the shutdown state and the ambient temperature is not lower than the preset temperature, the clock signal CKL is pulled up to the first potential VGH, and the first switching element T1 is turned on, and the clock signal CKL of the first potential VGH is output to the output end VOUT. When the display state is in the shutdown state, and the ambient temperature is lower than the preset temperature, the clock signal CKL is pulled up to the first potential VGH, and the second switching element T2 is turned on, and the clock signal CKL of the first potential VGH is amplified and output to the output end VOUT. That is, during the shutdown process of the display device, the clock signal CKL outputted to the output end VOUT can be pulled up to the correct potential according to the change of the ambient temperature, so that under different ambient temperatures, the correct scan signals are generated according to the clock signal CKL pulled up to the correct potential to completely turn on the switching elements in the pixels, thereby completely releasing the charge within the pixels to avoid occurrence of LPS horizontal stripes.

It should be noted that the structures and connection relationships of the circuits in FIG. 1 are merely exemplary and are not intended to limit the present disclosure.

Figure 2:
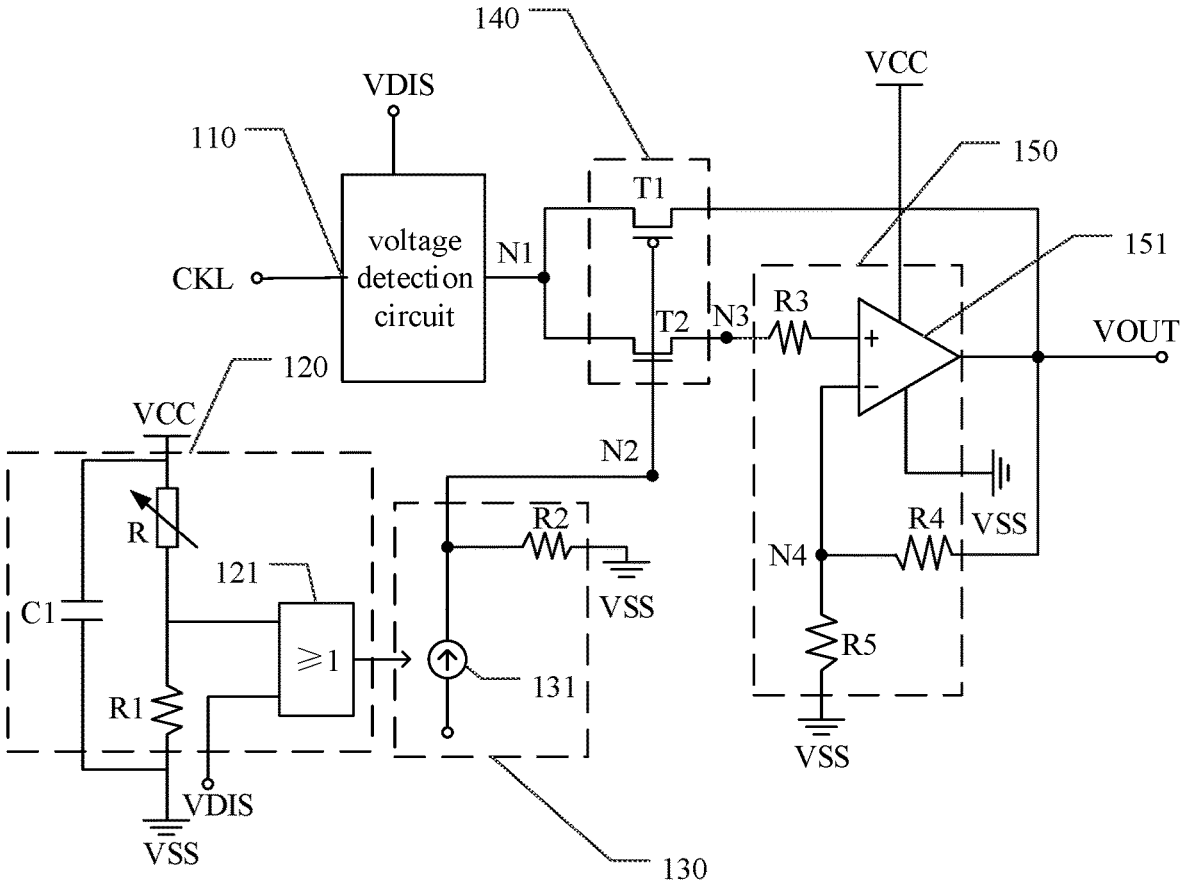
FIG. 2 is a schematic diagram of a clock signal auxiliary circuit according to an embodiment of the present disclosure.

On the basis of the output of the circuit in FIG. 1, as shown in FIG. 2, the thermal sensitive sensing circuit 120 may further include a first storage capacitor C1. A first end of the first storage capacitor C1 receives the first power signal VCC, and a second end of the first storage capacitor C1 receives the second power signal VSS.

Figure 3:
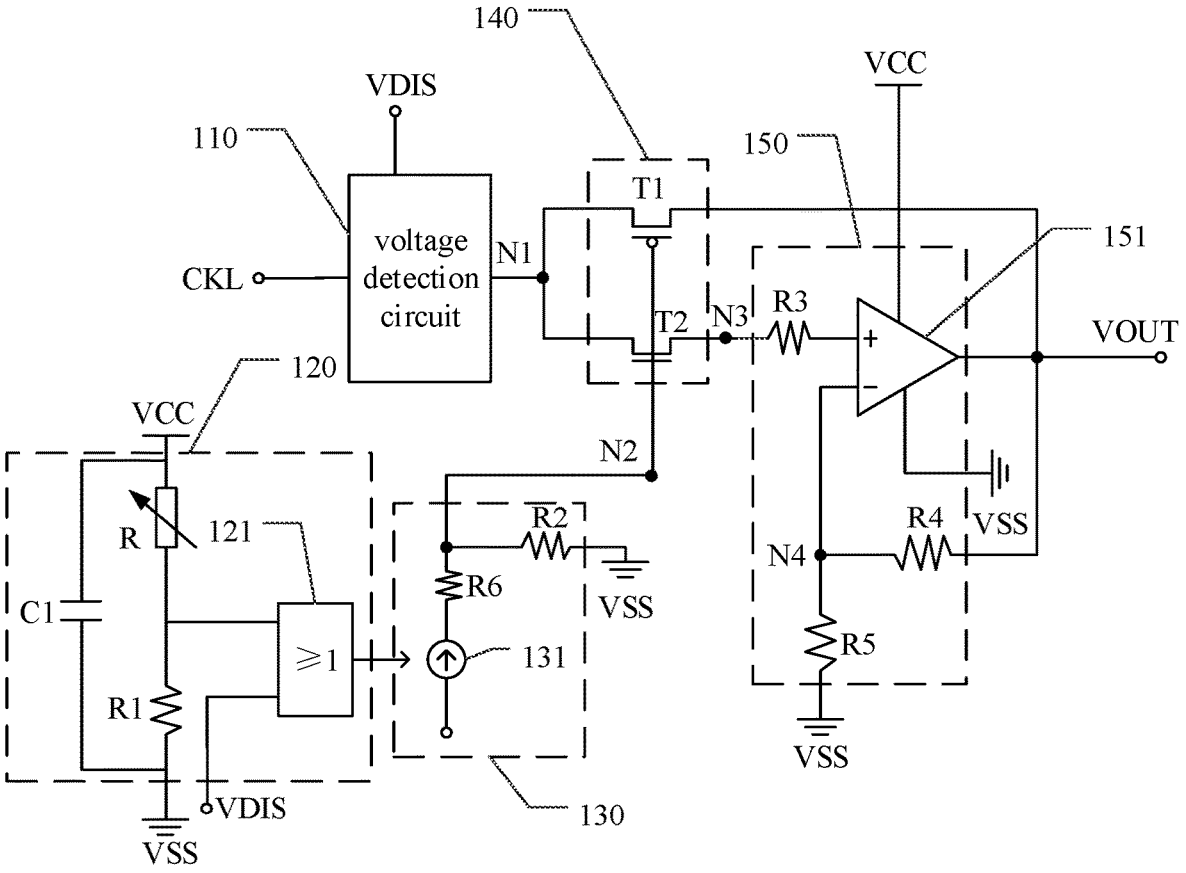
FIG. 3 is a schematic diagram of a clock signal auxiliary circuit according to an embodiment of the present disclosure.

On the basis of FIG. 2, as shown in FIG. 3, the control circuit 130 may further include a sixth resistor R6. A first end of the sixth resistor R6 is connected to the second end of the current source 131, and a second end of the sixth resistor R6 is connected to the second node N2.

Figure 4:
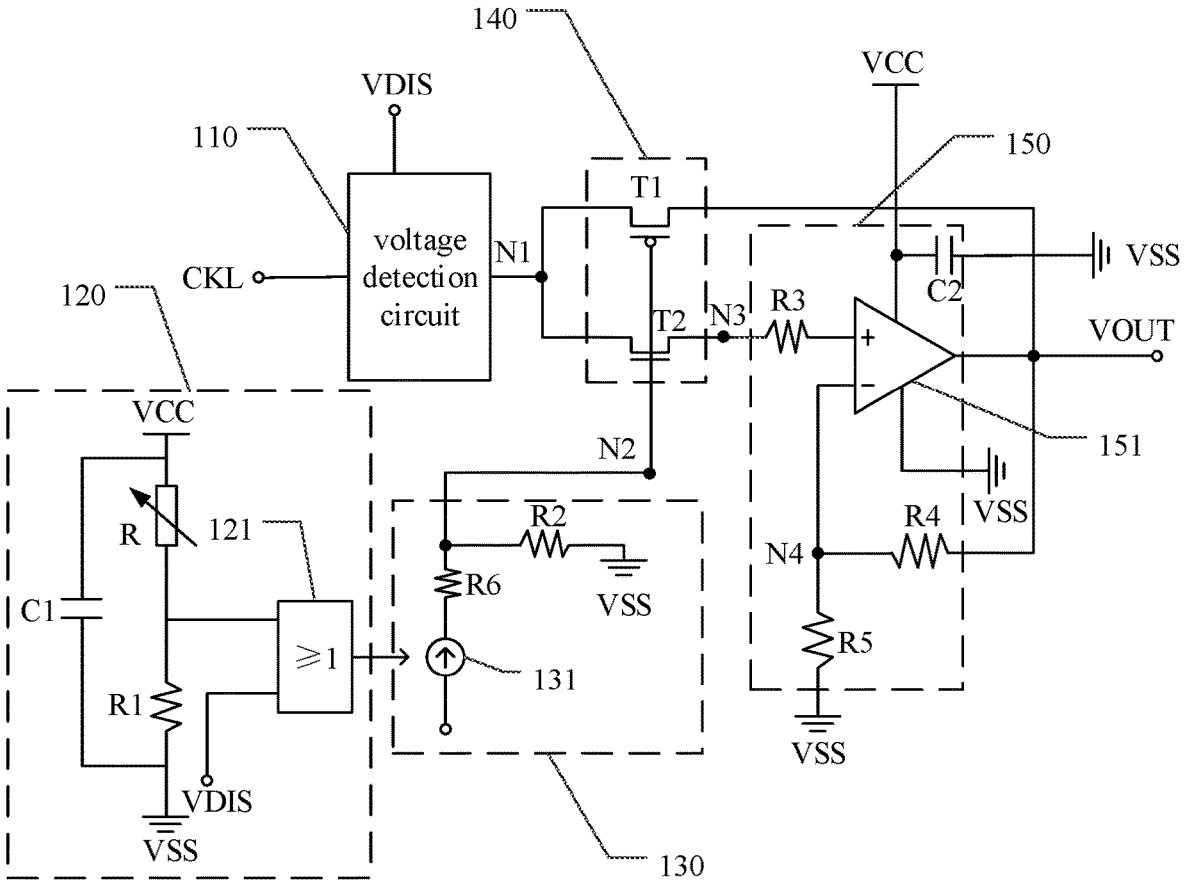
FIG. 4 is a schematic diagram of a clock signal auxiliary circuit according to an embodiment of the present disclosure.

On the basis of FIG. 3, as shown in FIG. 4, the signal amplification circuit 150 may further include a second storage capacitor C2. A first end of the second storage capacitor C2 receives the first power signal VCC, and a second end of the second storage capacitor C2 receives the second power signal VSS.

An example embodiment also provides a display device including the above-described clock signal auxiliary circuit. The display device includes: a plurality of scan lines configured to provide scan signals; a plurality of data lines configured to provide data signals; a plurality of pixel drive circuits electrically connected to the scan lines and the data lines; and a plurality of shift registers configured to provide scan signals to the scan lines; the clock signal auxiliary circuit electrically connected to the plurality of shift registers and configured to provide a clock signal to the shift register, wherein the clock signal auxiliary circuit is any of the above clock signal auxiliary circuits in the exemplary embodiments. The display device may include any product or component having a display function, such as a mobile phone, a tablet computer, a television, a notebook computer, a digital photo frame, a navigator, and the like.

According to an example embodiment, the shift register is used for generate scan signals for a display device, for example, LCD (liquid crystal display), OLED (organic light emitting diode), and so on. The shift register may be formed by a plurality of transistors, or may be formed by digital circuits.

It should be noted that the specific details of each circuit or unit in the display device have been described in detail in the corresponding overcurrent protection circuit, and therefore will not be described herein.

It should be noted that although circuits or units of devices for executing functions are described above, such division of circuits or units is not mandatory. In fact, features and functions of two or more of the circuits or units described above may be embodied in one circuit or unit in accordance with the embodiments of the present disclosure. Alternatively, the features and functions of one circuit or unit described above may be further divided into multiple circuits or units.

In addition, although the various steps of the method of the present disclosure are described in a particular order in the figures, this is not required or implied that the steps must be performed in the specific order, or all the steps shown must be performed to achieve the desired result. Additionally or alternatively, certain steps may be omitted, multiple steps may be combined into one step, and/or one step may be decomposed into multiple steps and so on.

Other embodiments of the present disclosure will be apparent to those skilled in the art. The present application is intended to cover any variations, uses, or adaptations of the present disclosure, which are in accordance with the general principles of the present disclosure and include common general knowledge or conventional technical means in the art that are not disclosed in the present disclosure. The specification and embodiments are illustrative, and the real scope and spirit of the present disclosure is defined by the appended claims.

What is claimed is:

1. A clock signal auxiliary circuit configured to provide a clock signal to a shift register, the clock signal auxiliary circuit comprising:

a voltage detection circuit connected to a first node, and configured to detect an operating voltage, pull the clock signal up to a first potential when the operating voltage is lower than a preset voltage, and provide the clock signal after being pulled up to the first node, a first end of the voltage detection circuit receiving the clock signal, a second end of the voltage detection circuit receiving the operating voltage, and a third end of the voltage detection circuit being connected to the first node;

a thermal sensitive sensing circuit configured to detect the operating voltage and an ambient temperature in real time, and output a detection signal according to the operating voltage and the ambient temperature, wherein the thermal sensitive sensing circuit comprises:

a first resistor, a first end of the first resistor receiving a second power signal;

a thermistor, a first end of the thermistor being connected to a second end of the first resistor, and a second end of the thermistor receiving a first power signal; and a NOR gate, a first end of the NOR gate being connected to the second end of the first resistor, and a second end of NOR gate receiving the operating voltage;

a control circuit connected to the thermal sensitive sensing circuit and a second node, and configured to provide a control signal to the second node according to the detection signal, wherein the control circuit comprises:

a current source, a first end of the current source being connected to a third end of the NOR gate, a second end of the current source being connected to the second node, and the current source being configured to generate a current according to the detection signal and provide the control signal to the second node according to the current; and a second resistor, a first end of the second resistor being connected to the second node and a second end of the second resistor receiving the second power signal;

a switch selection circuit connected to the first node, the second node, a third node, and an output end, and configured to connect the first node and the output end or connect the first node and the third node in response to the control signal of the second node, wherein the switch selection circuit comprises:

a first switching element, a control end of the first switching element being connected to the second node, a first end of the first switching element being connected to the first node, and a third end of the first switching element being connected to the output end; and a second switching element, a control end of the second switching element being connected to the second node, a first end of the second switching element being connected to the first node, and a second end of the second switching element being connected to the third node, wherein the first switching element and the second switching element have opposite conduction levels; and a signal amplification circuit connected to the third node and the output end, and configured to amplify a signal of the third node and output the signal as amplified to the output end, wherein the signal amplification circuit comprises:

a third resistor, a first end of the third resistor being connected to the third node;

an operational amplifier, a first end of the operational amplifier being connected to a second end of the third resistor, a second end of the operational amplifier being connected to a fourth node, a third end of the operational amplifier being connected to the output end, a fourth end of the operational amplifier receiving the first power signal, and a fifth end of the operational amplifier receiving the second power signal;

a fourth resistor, a first end of the fourth resistor being connected to the output end and a second end of the fourth resistor being connected to the fourth node; and a fifth resistor, a first end of the fifth resistor being connected to the fourth node and a second end of the fifth resistor receiving the second power signal.

2. The clock signal auxiliary circuit according to claim 1, wherein the thermal sensitive sensing circuit is configured to:

output a first detection signal when the operating voltage is lower than the preset voltage and the ambient temperature is lower than a preset temperature; and output a second detection signal when the operating voltage is lower than the preset voltage and the ambient temperature is higher than the preset temperature.

3. The clock signal auxiliary circuit according to claim 2, wherein the control circuit is configured to:

provide a first control signal to the second node according to the first detection signal; and provide a second control signal to the second node according to the second detection signal.

4. The clock signal auxiliary circuit according to claim 3, wherein the switch selection circuit is specifically configured to:

connect the first node and the third node in response to the first control signal; and connect the first node and the output end in response to the second control signal.

5. The clock signal auxiliary circuit according to claim 1, wherein the thermal sensitive sensing circuit further comprises: a first storage capacitor, wherein a first end of the first storage capacitor receives the first power signal, and a second end of the first storage capacitor receives the second power signal.

6. The clock signal auxiliary circuit according to claim 5, wherein the control circuit further comprises: a sixth resistor, wherein a first end of the sixth resistor is connected to the second end of the current source, and a second end of the sixth resistor is connected to the second node.

7. The clock signal auxiliary circuit according to claim 6, wherein the signal amplification circuit further comprises: a second storage capacitor, wherein a first end of the second storage capacitor receives the first power signal, and a second end of the second storage capacitor receives the second power signal.

8. The clock signal auxiliary circuit according to claim 1, wherein the first switching element is a P-type transistor, and the second switching element is an N-type transistor; or the first switching element is an N-type transistor, and the second switching element is a P-type transistor.

9. A display device comprising a clock signal auxiliary circuit, wherein the clock signal auxiliary circuit comprises:

a voltage detection circuit connected to a first node, and configured to detect an operating voltage, pull a clock signal up to a first potential when the operating voltage is lower than a preset voltage, and provide the clock signal after being pulled up to the first node a first end of the voltage detection circuit receiving the clock signal, a second end of the voltage detection circuit receiving the operating voltage, and a third end of the voltage detection circuit being connected to the first node;

a thermal sensitive sensing circuit configured to detect the operating voltage and an ambient temperature in real time, and output a detection signal according to the operating voltage and the ambient temperature, wherein the thermal sensitive sensing circuit comprises:

a first resistor, a first end of the first resistor receiving a second power signal;

a thermistor, a first end of the thermistor being connected to a second end of the first resistor, and a second end of the thermistor receiving a first power signal; and a NOR gate, a first end of the NOR gate being connected to the second end of the first resistor, and a second end of NOR gate receiving the operating voltage;

a control circuit connected to the thermal sensitive sensing circuit and a second node, and configured to provide a control signal to the second node according to the detection signal, wherein the control circuit comprises:

a current source, a first end of the current source being connected to a third end of the NOR gate, a second end of the current source being connected to the second node, and the current source being configured to generate a current according to the detection signal and provide the control signal to the second node according to the current; and a second resistor, a first end of the second resistor being connected to the second node and a second end of the second resistor receiving the second power signal;

a switch selection circuit connected to the first node, the second node, a third node, and an output end, and configured to connect the first node and the output end or connect the first node and the third node in response to the control signal of the second node, wherein the switch selection circuit comprises:

a first switching element, a control end of the first switching element being connected to the second node, a first end of the first switching element being connected to the first node, and a third end of the first switching element being connected to the output end; and a second switching element, a control end of the second switching element being connected to the second node, a first end of the second switching element being connected to the first node, and a second end of the second switching element being connected to the third node, wherein the first switching element and the second switching element have opposite conduction levels; and a signal amplification circuit connected to the third node and the output end, and configured to amplify a signal of the third node and output the signal as amplified to the output end, wherein the signal amplification circuit comprises:

a third resistor, a first end of the third resistor being connected to the third node;

an operational amplifier, a first end of the operational amplifier being connected to a second end of the third resistor, a second end of the operational amplifier being connected to a fourth node, a third end of the operational amplifier being connected to the output end, a fourth end of the operational amplifier receiving the first power signal, and a fifth end of the operational amplifier receiving the second power signal;

a fourth resistor, a first end of the fourth resistor being connected to the output end and a second end of the fourth resistor being connected to the fourth node; and a fifth resistor, a first end of the fifth resistor being connected to the fourth node and a second end of the fifth resistor receiving the second power signal.

10. The display device according to claim 9, wherein the thermal sensitive sensing circuit is configured to:

output a first detection signal when the operating voltage is lower than the preset voltage and the ambient temperature is lower than a preset temperature; and output a second detection signal when the operating voltage is lower than the preset voltage and the ambient temperature is higher than the preset temperature.

11. The display device according to claim 10, wherein the control circuit is configured to:

provide a first control signal to the second node according to the first detection signal; and provide a second control signal to the second node according to the second detection signal.

12. The display device according to claim 11, wherein the switch selection circuit is specifically configured to:

connect the first node and the third node in response to the first control signal; and connect the first node and the output end in response to the second control signal.

13. The display device according to claim 9, wherein the thermal sensitive sensing circuit further comprises: a first storage capacitor, wherein a first end of the first storage capacitor receives the first power signal, and a second end of the first storage capacitor receives the second power signal.

14. The display device according to claim 13, wherein the control circuit further comprises: a sixth resistor, wherein a first end of the sixth resistor is connected to the second end of the current source, and a second end of the sixth resistor is connected to the second node.

15. The display device according to claim 14, wherein the signal amplification circuit further comprises: a second storage capacitor, wherein a first end of the second storage capacitor receives the first power signal, and a second end of the second storage capacitor receives the second power signal.

16. The display device according to claim 9, wherein the first switching element is a P-type transistor, and the second switching element is an N-type transistor; or the first switching element is an N-type transistor, and the second switching element is a P-type transistor.

17. A method, comprising:

providing a clock signal auxiliary circuit, wherein the clock signal auxiliary circuit comprises:

a voltage detection circuit connected to a first node, and configured to detect an operating voltage, pull the clock signal up to a first potential when the operating voltage is lower than a preset voltage, and provide the clock signal after being pulled up to the first node, a first end of the voltage detection circuit receiving the clock signal, a second end of the voltage detection circuit receiving the operating voltage, and a third end of the voltage detection circuit being connected to the first node;

a thermal sensitive sensing circuit configured to detect the operating voltage and an ambient temperature in real time, and output a detection signal according to the operating voltage and the ambient temperature, wherein the thermal sensitive sensing circuit comprises:

a first resistor, a first end of the first resistor receiving a second power signal;

a thermistor, a first end of the thermistor being connected to a second end of the first resistor, and a second end of the thermistor receiving a first power signal; and a NOR gate, a first end of the NOR gate being connected to the second end of the first resistor, and a second end of NOR gate receiving the operating voltage;

a control circuit connected to the thermal sensitive sensing circuit and a second node, and configured to provide a control signal to the second node according to the detection signal, wherein the control circuit comprises:

a current source, a first end of the current source being connected to a third end of the NOR gate, a second end of the current source being connected to the second node, and the current source being configured to generate a current according to the detection signal and provide the control signal to the second node according to the current; and a second resistor, a first end of the second resistor being connected to the second node and a second end of the second resistor receiving the second power signal;

a switch selection circuit connected to the first node, the second node, a third node, and an output end, and configured to connect the first node and the output end or connect the first node and the third node in response to the control signal of the second node, wherein the switch selection circuit comprises:

a first switching element, a control end of the first switching element being connected to the second node, a first end of the first switching element being connected to the first node, and a third end of the first switching element being connected to the output end; and a second switching element, a control end of the second switching element being connected to the second node, a first end of the second switching element being connected to the first node, and a second end of the second switching element being connected to the third node, wherein the first switching element and the second switching element have opposite conduction levels; and a signal amplification circuit connected to the third node and the output end, and configured to amplify a signal of the third node and output the signal as amplified to the output end, wherein the signal amplification circuit comprises:

a third resistor, a first end of the third resistor being connected to the third node;

an operational amplifier, a first end of the operational amplifier being connected to a second end of the third resistor, a second end of the operational amplifier being connected to a fourth node, a third end of the operational amplifier being connected to the output end, a fourth end of the operational amplifier receiving the first power signal, and a fifth end of the operational amplifier receiving the second power signal;

a fourth resistor, a first end of the fourth resistor being connected to the output end and a second end of the fourth resistor being connected to the fourth node; and a fifth resistor, a first end of the fifth resistor being connected to the fourth node and a second end of the fifth resistor receiving the second power signal.

18. The method of claim 17, further comprising providing the clock signal auxiliary circuit in a display device.

19. The method according to claim 17, wherein the control circuit further comprises a sixth resistor, a first end of the sixth resistor being connected to the second end of the current source, and a second end of the sixth resistor being connected to the second node.

20. The method according to claim 17, wherein:

the first switching element is a P-type transistor and the second switching element is an N-type transistor; or the first switching element is an N-type transistor and the second switching element is a P-type transistor.

* * * * *